US005647007A

United States Patent [19]

Wooderson et al.

[11] Patent Number: 5,647,007

[45] Date of Patent: Jul. 8, 1997

[54] OPTIMIZED SOUND COMPONENTS FOR HAIR DRYER STEREO SYSTEM

[75] Inventors: Blaise M. Wooderson; Lewis A. Mendelson, both of Industrial Airport, Kans.; Yi Hsiung Chung, Taipei Shien, Taiwan

[73] Assignee: Helen of Troy Limited, Barbados

[21] Appl. No.: 482,614

[22] Filed: Jun. 7, 1995

Related U.S. Application Data

[63] Continuation-in-part of Ser. No. 395,712, Feb. 28, 1995, which is a continuation-in-part of Ser. No. 361,734, Dec. 22, 1994.

[51] Int. Cl.[6] ..... H04R 1/02

[52] U.S. Cl. ..... 381/90; 381/204; 381/205

[58] Field of Search ..... 381/202, 204, 381/188, 205, 90, 77, 87, 24; 181/150

[56] References Cited

U.S. PATENT DOCUMENTS

| | | | |
|---|---|---|---|
| 1,887,185 | 2/1932 | Quinby | 181/150 |
| 2,541,980 | 2/1951 | Antone . | |
| 2,966,550 | 12/1960 | Golberg et al. | 381/77 |
| 3,230,320 | 1/1966 | Kerr . | |
| 3,237,713 | 3/1966 | Leslie . | |
| 3,575,370 | 4/1971 | Morris et al. | 381/188 |
| 3,716,671 | 2/1973 | Karr | 381/205 |
| 3,812,575 | 5/1974 | Hedman | 381/191 |
| 3,938,057 | 2/1976 | Minot | 381/120 |
| 4,020,284 | 4/1977 | Phillips . | |
| 4,297,537 | 10/1981 | Babb | 381/204 |
| 4,439,643 | 3/1984 | Schweizer | 381/188 |
| 4,546,850 | 10/1985 | Litner | 381/188 |
| 4,641,014 | 2/1987 | Bland . | |
| 4,852,178 | 7/1989 | Inkman et al. | 381/205 |
| 4,853,966 | 8/1989 | Skrzycki | 381/188 |
| 5,416,283 | 5/1995 | Dault et al. | 381/205 |
| 5,452,365 | 9/1995 | Kalis | 381/188 |

OTHER PUBLICATIONS

1987 Dellco catalog, p. 151.

1992–1993 Service Merchandise Jewelry and General Merchandise catalog, p. 303.

Lady Carel Salon Hair.

Lady Dazey.

Lady Dazey 1400 Hair Dryer.

Dazey Natural Wonder 1400.

*Primary Examiner*—Curtis Kuntz

*Assistant Examiner*—Vivian W. Chang

*Attorney, Agent, or Firm*—Baker & McKenzie

[57] ABSTRACT

A bonnet style hair dryer includes integral left and right speakers. Each of the speakers is positioned proximate a respective ear of the user when the bonnet is placed over the user's head. A stereo audio cable is connected to the speakers with the opposite end connected to a stereo audio jack positioned within the bonnet. The speakers can thus be connected, via a removable external audio cable, to any suitable audio source so that a user can receive audio entertainment or information while her or his hair is being dried. The external audio cable may have an in-line stereophonic audio amplifier incorporated therein. The speakers have speaker cones which are heat formed from a polyester film to increase the efficiency of the speakers. The speaker cones may also have radial or tangential ribs formed therein. A one-piece folding speaker holder provides for toolless mounting of the speakers within the hair dryer bonnet.

27 Claims, 5 Drawing Sheets

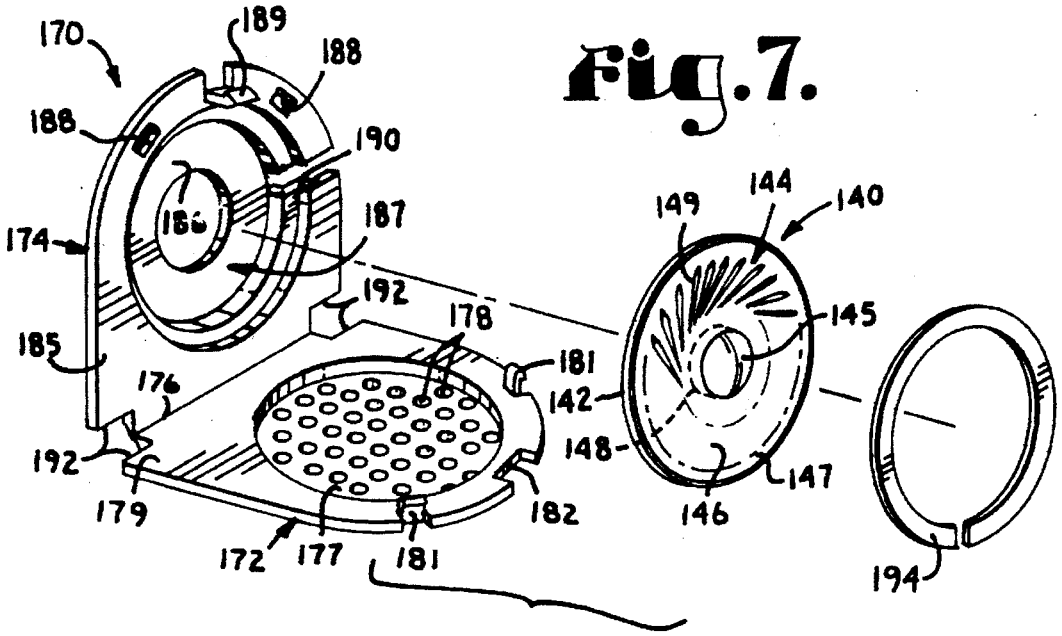
Fig.7.
Fig.8.
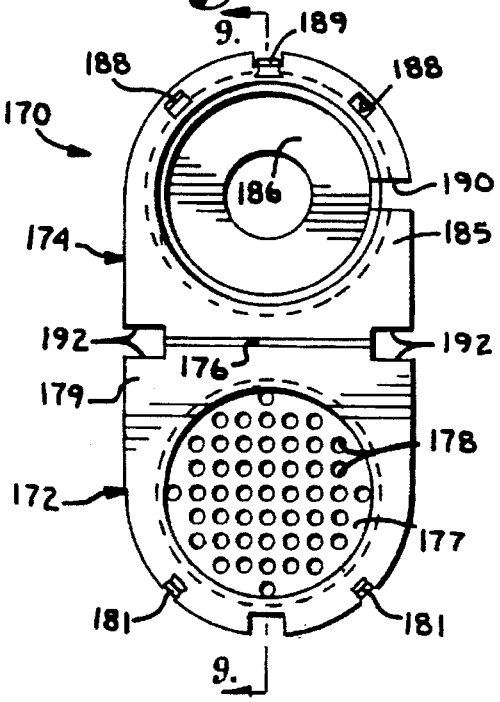
Fig.9
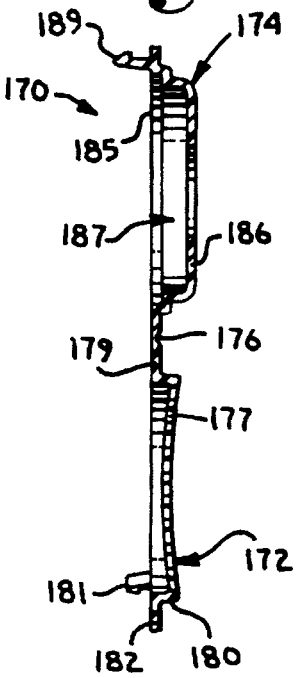

OPTIMIZED SOUND COMPONENTS FOR HAIR DRYER STEREO SYSTEM

CROSS REFERENCE TO RELATED APPLICATIONS

This application is a continuation-in-part of copending application Ser. No. 08/395,712 entitled HAIR DRYER WITH INTEGRAL STEREO AUDIO SYSTEM filed Feb. 28, 1995, which is a continuation-in-part of Ser. No. 08/361,734 entitled HAIR DRYER WITH INTEGRAL STEREO AUDIO SYSTEM, filed Dec. 22, 1994.

BACKGROUND OF THE INVENTION

1. Field of the Invention

This invention is directed to a hair dryer with a rigid bonnet which is lowered over a user's head and into which heated air is blown for hair drying purposes. More particularly, the inventive hair dryer includes an integral stereo audio system with a pair of stereo earphones or speakers which are physically built into the rigid bonnet, with one speaker placed proximate to each ear of the user. An alternative embodiment utilizes a soft bonnet with an integral pair of stereo speakers physically included therewith. In either embodiment, an audio jack is connected to the speakers and a removable external audio cable allows the speakers to be connected to any suitable source of audio information or entertainment. In either embodiment, the speakers can also be connected, via the external audio cable, to lap top computers and video games. In both embodiments, an air deflector may be placed around the speakers within the bonnet such that heated air is not blown directly onto the speakers.

2. Description of the Related Art

Hair dryers equipped with bonnets through which heated air is blown to dry a user's hair have been known for some time. This type of hair dryer is a staple of commercial hair salons since it dries hair much faster, more evenly and more thoroughly than hand held "blow dryers". Bonnet style hair dryers for home consumer use have also been available, but in recent years have largely been superseded by hand held blow dryers. One problem with bonnet style hair dryers for home use is the need for the user to remain stationary for a relatively long time period. This situation, coupled with the necessity to wear a bonnet which prevents the user from accessing audio entertainment or information such as radio, television audio, music sources, computers, lap top computers and video games with audio signals, has limited the popularity and marketability of consumer-oriented bonnet-style hair dryers.

It is clear then, that a need exists for a bonnet style hair dryer which allows a user to access audio entertainment or information while the hair dryer is in use. At the same time, such a hair dryer should be attractive, relatively simple and economical to produce and sell, should not incorporate unnecessary electronic components which are subject to failure during the life of the hair dryer, and should be selectively connectable to any suitable audio entertainment or information source.

There are problems associated with incorporating audio speakers into bonnet type hair dryers. The dryer fan, the fan motor, and the flow of air propelled by the fan all generate noise which interferes with the quality of sound projected from the speakers. In the soft bonnet dryers, the speakers are positioned in close proximity to the ears of the user, and there is less degradation of sound for this reason. The bonnet or hood of the hard bonnet type dryer is oversized to accommodate hair styling devices such as rollers and is sized with several inches of clearance about the head of the user. Such oversizing positions the speakers several inches from the user's ears.

The dryer bonnet speakers are intended for use with a wide variety of audio sources ranging from small personal FM radios and handheld television sets, to larger portable radio/tape player combinations, up to conventional home stereo system components. The smaller radios, cassette and CD (compact disc) players, and handheld televisions usually have low power audio outputs on the order of a half watt or less. Larger portable audio sources tend to have power outputs in the range of five or ten watts. Home stereo systems tend to have much higher power outputs. Many audio sources have a headphone jack which connects to a preamp stage of the device and which disconnects the signal input to the power amplifier. This provides a low power audio signal to the headphones with control of volume and tone available to the listener.

Listeners of audio programs through bonnet hair dryer speakers tend to turn the volume of the source up to overcome the interfering noise of the dryer itself and to compensate for the loss of volume and tone from the more distantly spaced speakers of the hard bonnet type dryers. When the listener disconnects the speaker cable from the headphone jack of a higher power audio source without turning the volume down, a high volume level audio signal is abruptly switched to the main speakers. This can be startling and, additionally, may cause damage to the main speakers. Thus, there is a need for increasing the volume of audio from dryer bonnet speakers, particularly those mounted in a hard bonnet dryer, without increasing the source volume level.

SUMMARY OF THE INVENTION

In the practice of the present invention, a first embodiment of a bonnet style hair dryer includes a rigid bonnet with an integral stereophonic or stereo audio system with a pair of stereo speakers. One of the speakers is positioned proximate each ear of a user when the bonnet is placed over his or her head. In a second embodiment, the bonnet is flexible, but also incorporates a pair of stereo speakers therein. In both embodiments, a two conductor stereo audio cable is separately attached to each speaker and extends between the speakers and a stereophonic telephone type audio input jack. A removable external audio cable is selectively connectable between the audio input jack and any suitable audio signal source, including radio, television audio, tape player, stereo music source, compact disc player, computer, lap top computer, video game, etc. so that a user can conveniently receive stereo or monaural audio entertainment or information while his or her hair is being dried. Within the bonnets, a deflector may be positioned around the speakers such that heated air is prevented from reaching the speakers.

Each of the speakers is preferably a high efficiency speaker so that an adequate level of audio volume will be projected from the speakers when the audio source volume is at a relatively low level. In the hard bonnet dryer particularly, the speakers have a nominal diameter of about two inches (five centimeters) and have speaker cones constructed of a polymeric or polyester film, such as Mylar (DuPont), of a selected film thickness which is heat formed to a desired shape. In the present invention the film from which the speakers are constructed has a thickness of about 75 micrometers. It has been found that the fidelity or sound quality of the speakers, in the hair dryer environment, is improved by forming radial or tangential ribs in the speaker cones about the speaker dome.

Increasing the efficiency of the speakers may not be quite enough of an improvement in the hard bonnet dryer because of the spacing of the speakers from the user's ears. The increased spacing diminishes the volume of the acoustic signal from the speakers and, additionally, allows the noise generated by the dryer mechanism to reach the user's ears. To overcome this and provide a better quality of sound from the speakers at a relatively low source volume level, the present invention provides an in-line stereophonic amplifier in the audio cable from the audio signal source to the speakers. The amplifier may have a relatively low power gain, on the order of three decibels (a power doubling), to avoid exceeding the power rating of the speakers. Such an amplifier may be relatively simple in design and, thus, inexpensive and may be adequately powered by a rectangular nine volt battery or a pair of AA or AAA 1.5 volt batteries.

The present invention provides a speaker mounting or holding assembly for toollessly mounting each of the speakers within the hard bonnet type of dryers. The speaker holder is a one piece folding member formed by a front grill and a rear speaker case which are joined by an integral hinge region. Either the grill or the case half includes a pair of latch pawls and the other includes a pair of pawl receiver apertures which are aligned with the latch pawls when the grill and case are folded together. A speaker is positioned in the speaker case half with the cone facing outward, and the grill is closed to engage the latch pawls with the pawl receiver apertures. An audio cable notch is formed in the case half to accommodate an audio signal cable connected to the speaker coil terminals. The case portion has a mounting pawl which extends through a mounting pawl notch in the grill portion. Lower edges of the case and grill portions have mounting notches formed therein.

The inner liner of a dryer hard bonnet has a speaker aperture formed therethrough, and a speaker mounting notch is formed at a top edge of the speaker aperture. A pair of speaker mounting lugs are formed below the speaker aperture. The close and snapped speaker holder with a speaker encased therein is mounted from the outside surface of the bonnet liner by engaging the speaker holder mounting latches with the liner mounting lugs, and the speaker mounting pawl is engaged with the speaker mounting notch. Thus, using the speaker holder of the present invention, the speakers can be mounted within the hard bonnet of the dryer quickly and efficiently and without the use of tools.

OBJECTS AND ADVANTAGES OF THE INVENTION

The principle objects and advantages of the present invention include: to provide a bonnet style hair dryer with an integral stereo audio system; to provide such a hair dryer in which a pair of stereo speakers are integrally attached within the bonnet with each speaker positioned proximate a respective ear of a user; to provide such a hair dryer with alternative rigid bonnet and soft bonnet construction; to provide such a hair dryer in which, in either embodiment, the stereo speakers are connected to a telephone type audio jack positioned within the bonnet with an opening extending through an outer shell of the bonnet; to provide such a hair dryer in which an external audio cable is selectively connectable between the audio jack and any suitable source of audio information or entertainment; to provide such an audio cable having an in-line stereophonic amplifier incorporated therein; to provide such a hair dryer which allows a user to conveniently access audio entertainment and information while his or her hair is being dried; to provide such a hair dryer in which the stereo audio system is virtually invisible when the external audio cable is removed; to provide speakers for such a hair dryer which have increased efficiency; to provide such speakers having speaker cones constructed of a polyester film of a selected thickness which are heat formed to shape; to provide such speakers having radial or tangential ribs molded in the speaker cones thereof; to provide a one piece folding speaker holder for convenient mounting of the speakers within the hard bonnet; to provide such a speaker holder including latch pawls which secure a speaker therein; to provide structure on the inner liner of the dryer bonnet which cooperates with structure on the speaker holder to enable the speaker holder with a speaker secured therein to be mounted on the bonnet liner without the use of tools; and to provide such a hair dryer with an audio speaker system which is attractive, reliable, economical to manufacture, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 7 is an enlarged exploded perspective view illustrating a one-piece folding speaker holder for mounting the speaker in the hard bonnet of a dryer.

FIG. 8 is an elevational view of the one-piece folding speaker holder.

FIG. 9 is a cross sectional view taken along line 9—9 of FIG. 8 and illustrates further details of the folding speaker holder.

DETAILED DESCRIPTION OF THE INVENTION

I. Introduction and Environment

Figure 1:
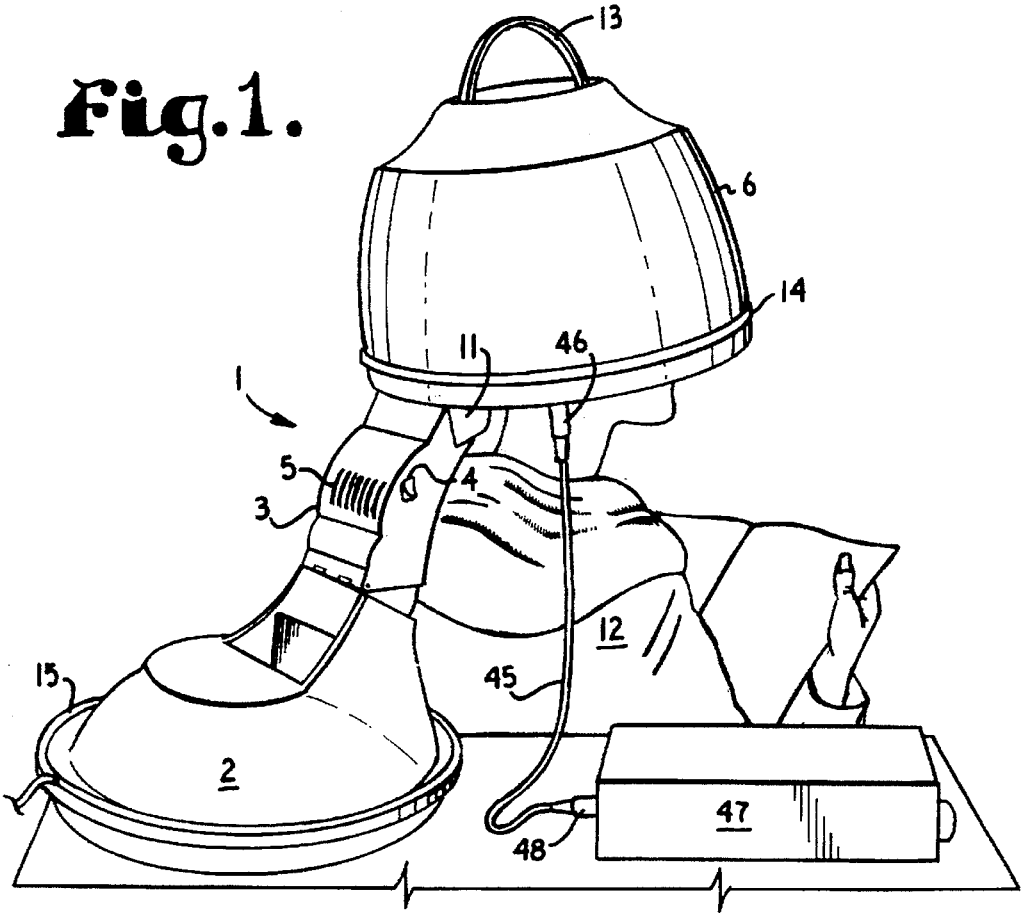
FIG. 1 is a perspective view of a rigid bonnet style hair dryer in accordance with the present invention, with the bonnet positioned on a user's head and with an external audio cable connected between an audio input jack in the bonnet and an audio source.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. The word "front" will refer to the forward or face side of a person or object having a denominated forward face or front side, while the word "back" will refer to the side of a person or object opposite the front side. Said terminology will include the words specifically mentioned, derivatives thereof, and words of a similar import.

II. Rigid Bonnet Hair Dryer

Referring to the drawings in more detail, FIG. 1 illustrates a rigid bonnet style hair dryer according to the present invention, generally designated as 1. The hair dryer 1 includes a base 2 within which is housed a heating element, motor and fan (not shown). The base 2 is hingedly connected to a lower end of a neck portion 3 within which an optional variable damper (not shown) can be positioned. A damper control 4 can be attached to control the damper position within the neck portion 3. With the optional variable damper and the damper control 4, drying air from the blower in the base 2 can be selectively diverted out of a louvered opening 5 or into a rigid hair drying bonnet 6. The rigid bonnet 6 is hingedly connected to the top end of the neck portion 3 by a hollow pivot connection 11 via which heated air is introduced into the rigid bonnet 6 in a conventional fashion. The rigid bonnet 6 is shown positioned over the head of a user 12. The rigid bonnet 6 also includes a carrying strap 13 attached to the top thereof, and the rigid bonnet 6 and the neck portion 3 can be selectively pivoted backward such that a sealing grommet 14 which encircles the rigid bonnet 6 rests on a rim 15 of the base 2 to close the hair dryer into a compact package for storage or transport.

III. Rigid Hair Dryer Bonnet and Stereo Audio System

Figure 2:
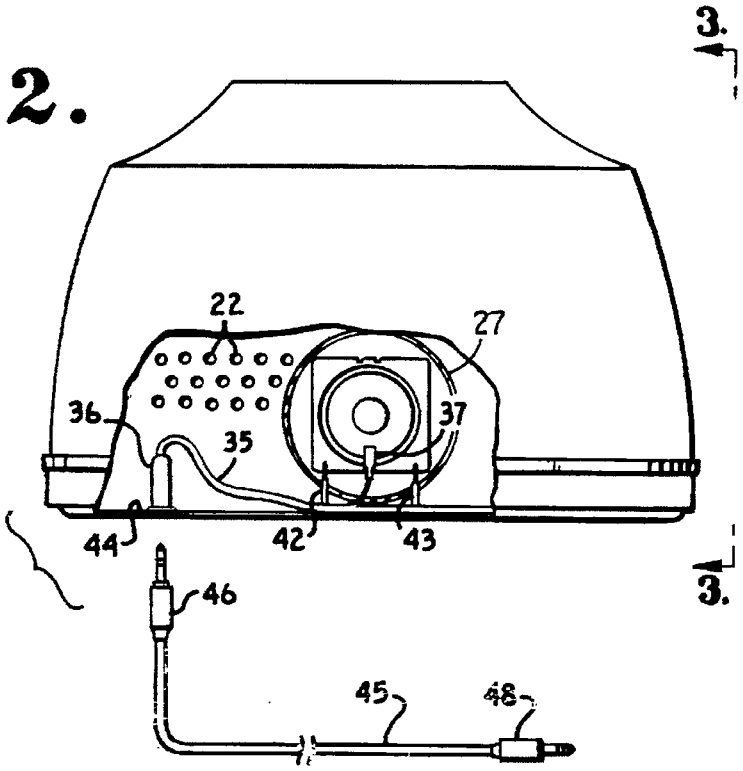
FIG. 2 is a side elevational view of the rigid hair dryer bonnet, with portions broken away to illustrate the mounting of a stereo speaker on one side of the bonnet and the position of an audio cable and input jack within the bonnet, and with the external audio cable positioned for connection to the audio input jack.
Figure 3:
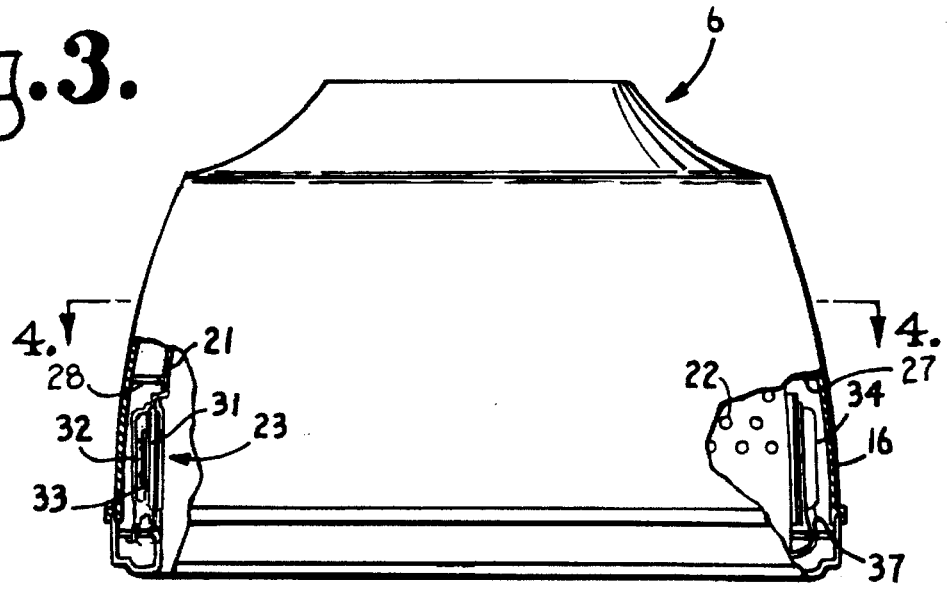
FIG. 3 is a front elevational view of the rigid hair dryer bonnet, with portions broken away to illustrate the mounting of stereo speakers on each side of the bonnet, and with one of the speakers shown in cross-section to illustrate the interior construction thereof.
Figure 4:
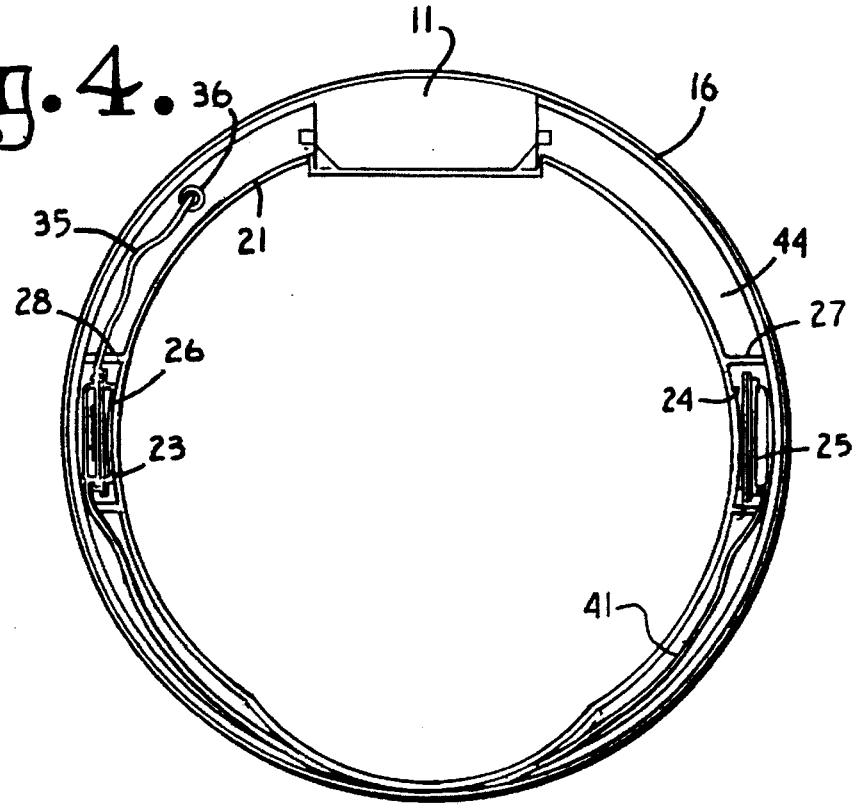
FIG. 4 is a cross-sectional view of the rigid hair dryer bonnet, taken along line 4—4 of FIG. 3, and illustrating the relative positions of the stereo speakers and the routing of an audio cable between the audio jack and the right speaker and between the speakers themselves.

Referring to FIGS. 2–4, the rigid bonnet 6 includes an outer shell 16 and an inner liner 21. The inner liner 21 is perforated with a plurality of air circulating apertures 22. Heated air is circulated between the outer shell 16 and the inner liner 21 and reaches the hair of the user 12 via the apertures 22.

The inner liner 21 includes right and left circular openings 23 and 24 which are positioned proximate the right and left ears, respectively, of the user 12. Left and right speakers 25 and 26, respectively, are positioned within the openings 24 and 23. Surrounding each of the speakers 25 and 26 are respective air deflectors 27 and 28. The deflectors 27 and 28 connect the outer shell 16 with the inner liner 21 peripherally around each of the speakers 25 and 26 to prevent heated air from being blown directly onto the speakers. This prevents the speakers 25 and 26 from being heated to a temperature which would make them uncomfortable in contact with the ears of the user 12, as well as extending the useful life of the speakers 25 and 26.

The speakers 25 and 26 are identical and thus only the right speaker 26 will be described in detail. The speaker 26, which is illustrated in cross section in FIGS. 3 and 4, includes a movable diaphragm 31 to which is attached a coil 32 positioned within a permanent magnet 33. An outer seal 34 encloses the diaphragm 31, coil 32 and magnet 33. The speakers 25 and 26 may be of the type which are employed in typical stereophonic headphone sets.

A three conductor stereo audio cable 35 is connected between a three conductor phone type audio input jack 36 and the right and left speakers 26 and 25. As is conventional in stereo audio cables, a right channel conductor and a common or ground conductor (not shown) in the cable 35 are connected to the movable coil 32 in the speaker 26 via clip-on terminals 37. A left channel conductor and ground conductor in the cable 35 extend, via a cable extension 41, around the periphery of the rigid bonnet 6 between the outer shell 16 and the inner liner 21 and connect to the left speaker 25 via clip-on terminals 37. Each of the speakers 25 and 26 is supported by a pair of supports 42 and 43 (FIG. 2) which connect to a continuous ledge 44 surrounding the interior base of the rigid bonnet 6 and in which the input jack 36 is mounted. Stereo audio signals are thus input through the jack 36 via the left and right channel and ground conductors in the cable 35 to respective ones of the speakers 25 and 26 such that the user 12 can conveniently listen to stereo or monaural audio information or entertainment while having her hair dried.

Referring to FIGS. 1 and 2, an external audio input cable 45 is shown connected at one end to the input jack 36 via a three conductor phone plug 46, and, in FIG. 1, at the opposite end to an audio source such as radio 47 via a three conductor phone plug 48.

The plugs 46 and 48 and jack 36 may be quarter inch phone type connectors, eighth inch type connectors, DIN connectors, or any other standard or commonly used type of audio connectors.

IV. Soft Hair Dryer Bonnet and Stereo Audio System

Figure 5:
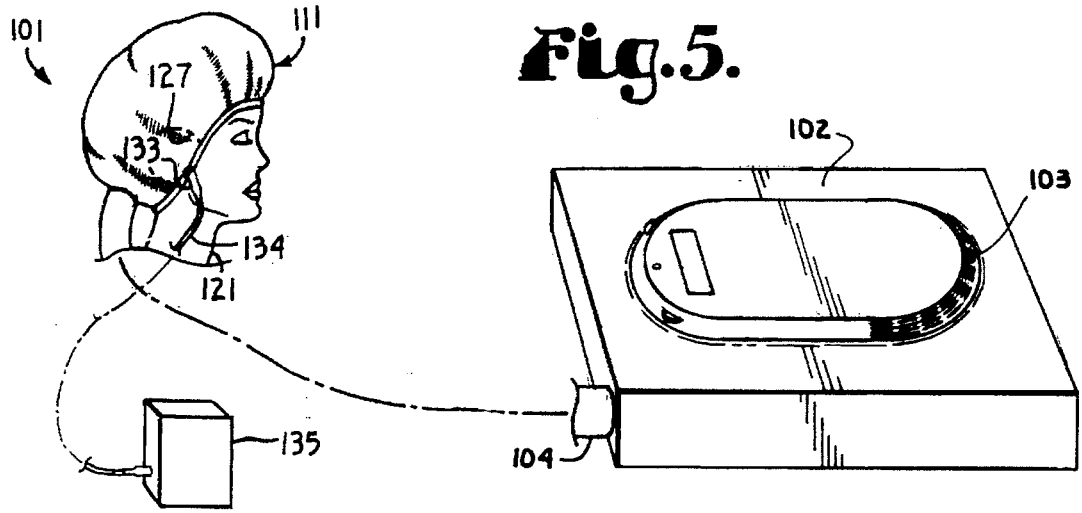
FIG. 5 is a perspective view of a soft bonnet style hair dryer in accordance with the present invention, with the bonnet positioned on a user's head and connected to a source of heated air via a flexible conduit and with an external audio cable connected between an audio input jack in the bonnet and an audio source.
Figure 6:
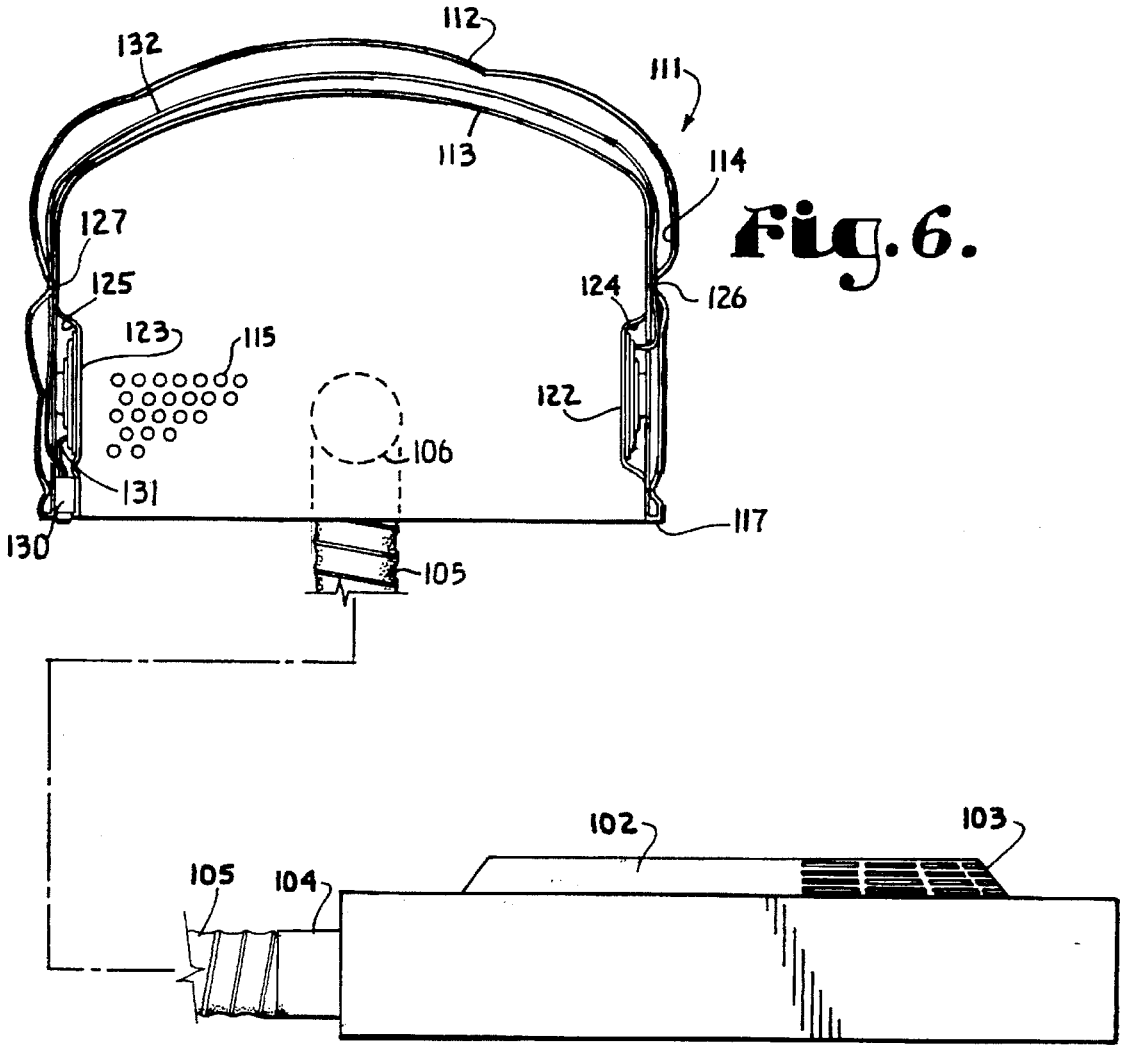
FIG. 6 is a side elevational view of the soft hair dryer bonnet, with portions broken away to illustrate the mounting of a stereo speaker on one side of the bonnet and the position of an audio cable and input jack within the bonnet.

Referring to FIGS. 5 and 6, an alternative, soft bonnet hair dryer, generally indicated as 101, is illustrated. The hair dryer 101 includes a base unit 102 incorporating a conventional heater, motor and fan (not shown) which heats air introduced through a grid 103 in the top of the base unit 102 and exhausts the heated air out an outlet 104. The outlet 104 of the base unit 102 is connected to one end of a flexible hose 105. A second end of the flexible hose 105 is connected to an air inlet 106 on a soft, flexible bonnet 111. The soft bonnet 111 includes an air impermeable flexible outer covering 112 and a flexible inner liner 113. The air inlet 106 opens into a space 114 between the outer covering 112 and the inner liner 113 to introduce heated air therein. As in the rigid bonnet 6, a number of apertures 115 are formed in the inner liner 113 such that heated air is blown through the apertures 115 and onto the hair of a user 121. A lower peripheral rim 117 of the bonnet 111 preferably has an elastic band (not shown) positioned therein to comfortably retain the bonnet 111 on the head of the user 121. The rim 117 fits somewhat loosely about the user's head to provide an outlet for the heated air and evaporated moisture.

As in the rigid bonnet 6, a pair of audio speakers 122 and 123 are attached to the soft bonnet 111 as an integral part thereof. The speakers 122 and 123, which have a structure similar to the speakers 23 and 24 in the rigid bonnet 6, are positioned within respective pockets 124 and 125 formed by flaps attached to the inner liner 113 of the bonnet 111. The speakers 122 and 123 are thus positioned in close proximity to the left and right ears, respectively, of the user 121 when the soft bonnet 111 is placed on her head. A pair of air deflecting seams 126 and 127, with the seam 127 shown in phantom lines in FIG. 5, are positioned around the speakers 122 and 123, respectively. As in the hard bonnet 6, the seams 126 and 127, which can be stitch lines or welds, for example, connect the outer covering 112 with the inner liner 113 peripherally around the speakers 122 and 123, respectively, to prevent heated air from being blown directly onto the speakers. This prevents the speakers 122 and 123 from being heated to a temperature which would make them uncomfortable in contact with the ears of the user 121. Furthermore, preventing heated air from reaching the speakers 122 and 123 extends the useful life of the speakers themselves.

As illustrated in FIG. 6, a three conductor phone jack 130 is attached to the inner liner 113 within the space 114 between the inner liner 113 and the outer covering 112. A short length of two conductor cable 131 is connected to a right channel terminal and the ground terminal (not shown) of the jack 130 at one end and to the right speaker 123 at the other end. A two conductor extension cable 132 is connected to a left channel terminal and a ground terminal (not shown) of the jack 130 and is threaded through the space 114 to the left speaker 122. For ease of viewing in the drawings, the extension cable 132 is shown, in FIG. 6, as threaded over the top of the inner lining 113, and thus over the top of the head of the user 121. It is understood that the extension cable 132 can also be threaded within the space 114 behind, and around the back of the head of the user 121 in a manner similar to that shown in FIG. 4 with respect to the threading of the cable extension 41. Indeed, the cable 132 can be threaded through the space 114 around the periphery of the soft bonnet 111 either in front of, or around the back of the head of the user 121. The audio jack 130 is positioned such that a stereo plug 133 from an audio cable 134 (FIG. 5) can be selectively plugged into the jack 130. The opposite end of the cable 134 is connected to a stereophonic source of audio, such as a radio 135 or the like.

While radios 47 and 135 are illustrated herein, it should be emphasized that the design of the inventive rigid bonnet 6 and the soft bonnet 111 allows the user 12 or 121 to be selectively connected to any suitable source of audio signals, including the radios 47 or 135, a television audio jack, CD or cassette player, computer lap top computer, video game or other audio source. At the same time, the fact that the input jacks 36 and 130 are entirely hidden within the interior of the rigid bonnet 6 and the soft bonnet 111, respectively, with the external cables 45 and 134 being removable, insures that, during times that the user 12 or 121 does not desire to listen to audio programming, the integral stereo system is virtually invisible from the exterior of the hair dryer 1 or 101. As an additional alternative, a radio or CD player or the like could be integrally incorporated into the base 2 or 102, with audio cabling routed to the bonnet 6 or 111 through an air flow passage, as defined by the neck portion 3 or the hose 105, respectively. The integral radio or CD player can also incorporate a jack for connection of an outside audio source through cabling of the radio or CD player.

Both the hard bonnet dryer 1 and soft bonnet dryer 101 are noisy environments for listening to audio programming because of fan and airflow noise generated by the dryers 1 and 101. The hard bonnet dryer 1 is particularly noisy since the speakers 25 and 26 therein are spaced about two inches from the ears of the user 12. This spacing not only allows more noise to reach the user's ears than the soft bonnet 101, but also diminishes the sound quality of the audio signal reaching the user's ears. To overcome the noise and decreased sound quality, users often turn up the source volume to increase the audio output from the speakers 25 and 25. With handheld sized radios, cassette players, and televisions, the increased source volume is usually not a problem. However, if the speakers 25 and 26 are connected to a high power home stereo system and the cable 45 is disconnected before the source volume is reduced, a high power audio signal is abruptly switched to the system speakers (not shown) which can be damaging to such speakers and at least startling to the user 12 and anyone in the vicinity.

The present invention provides apparatus for improving the sound quality of dryer mounted speakers. FIG. 7 illustrates an improved speaker 140. The speaker 140 includes a speaker frame 142 with an improved speaker diaphragm 144 mounted therein. The diaphragm 144 includes a central dome 145 with a conical speaker cone 146 surrounding same and terminating peripherally in a speaker rim 147. A voice coil 148 is attached to the back of the frame 142, as by gluing. The speaker 140 is assembled by placing the voice coil 148 in surrounding relation to a permanent speaker magnet (not shown) mounted within the speaker frame 142 and attaching the rim 147 of the diaphragm 142 to a rim of the speaker frame 142, as by an adhesive. The speaker 140 has a nominal diameter of two inches (five centimeters).

The speaker diaphragm 142 in the present invention is formed of a polymeric film, such as a polyester film which may be Mylar (DuPont trademark). Preferably, the film from which the diaphragm 142 is formed has a film thickness of about 75 micrometers (0.075 millimeter), with a tolerance of plus or minus 23 micrometers. Such a film thickness has been found to optimize the efficiency of the speaker 140 in the environment of the hard bonnet dryer 1 in the power level range at which the speaker 140 is operated. Additionally, it has been found that a plurality of tangential ribs 149 formed in the region of the cone 146 of the diaphragm 142 further increases the sound quality. The diaphragm 142 may be hot formed by heating the film and pressing it between a pair of heated dies (not shown). Alternatively, the diaphragm 142 may be vacuum formed.

Figure 12:
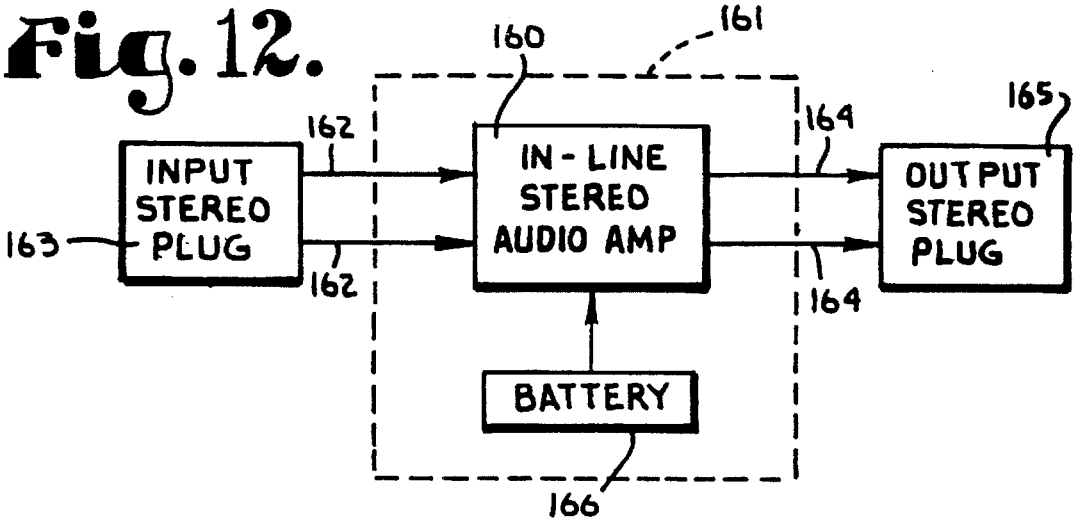
FIG. 12 is a simplified block diagram illustrating an in-line stereo amplifier for connection between a low power audio signal source and the speakers mounted within the hard bonnet of a hair dryer.

The increased efficiency of the speaker 140 reduces the need to increase the source volume of the audio signal source 47 or 135 by providing an increased acoustic volume from the speaker 140 for a given power level of the driving signal. Further gains in the acoustic volume of the speaker 140 may be realized by providing an in-line audio amplifier 160 within the external audio cable 45 or 134. FIG. 12 illustrates such an in-line amplifier 160. The amplifier 160 is stereophonic and is mounted within a small case 161. An input cable segment 162 is connected between the amplifier 160 and an input stereo plug 163 which is configured for connecting to the headphone jack of a stereophonic audio source, such as the radios 47 and 135. An output cable segment 164 is connected between the amplifier 160 and an output stereo plug 165 which is configured for connection to the dryer input jack 36 or 130. The amplifier 160 may be powered by a small battery 166, such as a rectangular nine volt battery or a pair of AA or AAA sized 1.5 volt batteries. The battery or batteries 166 are mounted within the case 161.

The present invention provides improved apparatus for mounting a speaker 140 in the liner 21 of a hard bonnet dryer 1 in the form of a one-piece folding speaker holder 170. Referring to FIGS. 7–9, the speaker holder 170 generally includes an inner grill portion 172 and an outer speaker case 174 which are connected by an integral hinge region 176. The grill 172 includes a circular grill wall 177 having a plurality of sound apertures 178 formed therein. The grill wall 177 is offset outwardly from a grill panel 179 to form a circular mounting shoulder 180. The illustrated grill 172 has a pair of latch pawls 181 extending perpendicularly from the grill panel 179. An end notch 182 is formed at an outer end of the grill panel 179.

The speaker case 174 includes a case panel 185 with a recessed case wall 186 forming a speaker receiving cavity 187 within the case 174. A pair of latch pawl receptacles 188 are formed through the case panel 185 and are positioned to be engaged by the latch pawls 181 when the holder 170 is folded closed. A mounting pawl 189 extends perpendicular to the case panel 185 and is positioned to extend through the end notch 182 of the grill 172. A speaker cable notch 190 is formed in the case 174 to accommodate a cable connecting to the voice coil 148 of a speaker 140 positioned in the closed holder 170.

The speaker holder 170 is molded of a synthetic resin, and the hinge 176 is formed as an integral or "living" hinge. Both the case panel 185 and the grill panel 179 have mounting notches 192 formed in the region of the hinge 176. The speaker 140 is positioned in the speaker cavity 187 with the frame 142 facing away from the case wall 186. The speaker 140 is oriented so that a speaker cable 193 extends through the cable notch 190. A packing gasket 194 is placed about the rim 147 of the diaphragm 144 to prevent the speaker 140 from vibrating within the closed holder 170. The grill 172 and case 174 are folded together about the hinge 176, and the latch pawls 181 are snapped into the receptacles 188.

Figure 10:
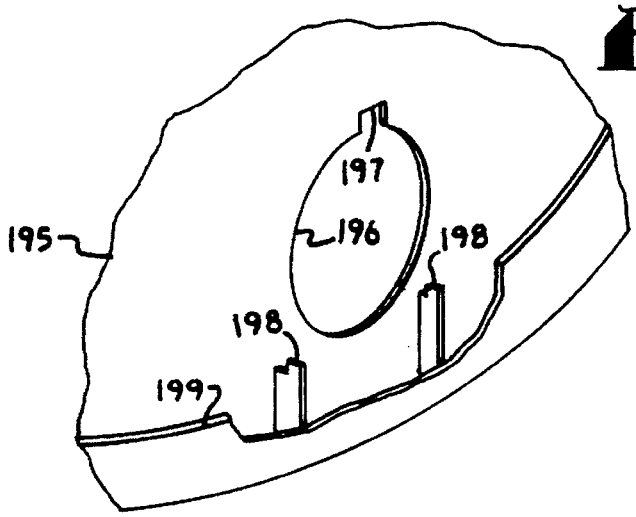
FIG. 10 is a fragmentary perspective view illustrating an inner liner of a dryer hard bonnet with a notched speaker aperture and mounting lugs which cooperate with the folding speaker holder to mount a speaker on the hard bonnet.
Figure 11:
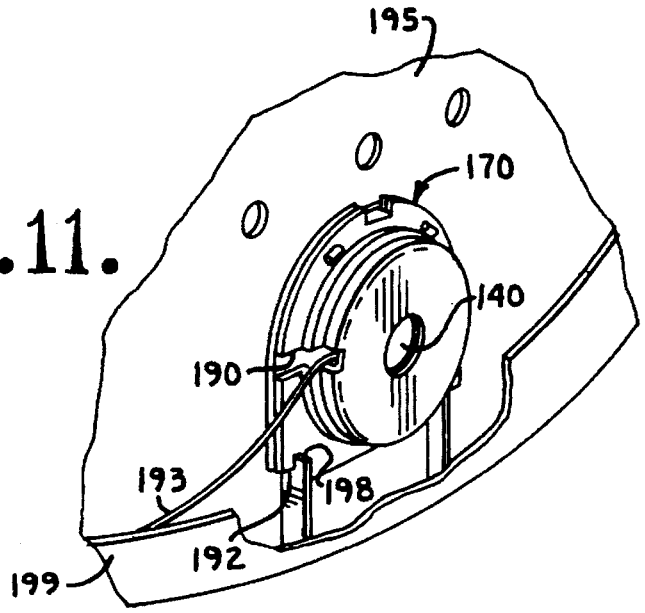
FIG. 11 is a view similar to FIG. 10 and illustrates the inner liner of the dryer hard bonnet having a speaker within a folding speaker holder mounted therein.

Referring to FIGS. 10 and 11, an inner liner 195 of a hard bonnet dryer 1 has a speaker mounting aperture 196 formed therein. A mounting notch 197 is formed at the top of the aperture 196. A pair of mounting lugs 198 are positioned below the aperture 196 near a lower rim 199 of the liner 195. The folded speaker holder 170 is mounted on the outside of the inner liner 195 by engaging the mounting notches 192 with the mounting lugs 198, engaging the shoulder 180 of the grill 172 with the edges of the speaker mounting aperture 196, and snapping the mounting lug 189 into the speaker mounting notch 197. The speaker holder 170, thus, provides an efficient and convenient means for mounting the speakers 140 in a hard bonnet type dryer 1 without the need for fasteners or tools to attach such fasteners.

It is to be understood that while certain forms of the present invention have been illustrated and described herein, it is not to be limited to the specific forms or arrangement of parts described and shown.

What is claimed and desired to be secured by Letters Patent is as follows:

1. A bonnet style hair dryer comprising:

(a) a dryer bonnet sized and shaped to accommodate the head of a user, hair dryer bonnet including a substantially rigid inner liner;

(b) a hair dryer mechanism selectively communicating heated air to said bonnet;

(c) a first audio speaker and speaker holder mounted within said bonnet in such a position and orientation that audio information can be selectively conveyed to the user during drying of the user's hair;

(d) a speaker aperture formed through said liner at a position to align with an ear of the user;

(e) a speaker mounting lug formed on said liner;

(f) a speaker mounting pawl formed on said speaker holder; and (g) said speaker holder is engageable with said lug and said pawl is engageable with said aperture to toollessly mount said holder and speaker on said bonnet.

2. A dryer as set forth in claim 1 wherein:

(a) said speaker includes a cone formed of a polyester film.

3. A dryer as set forth in claim 1 wherein:

(a) said speaker includes a cone formed of a polyester film having a film thickness of approximately 70 to 80 micrometers.

4. A dryer as set forth in claim 1 wherein:

(a) said speaker includes a cone with a speaker cone axis; and (b) a plurality of ribs are formed in said cone about said speaker cone axis.

5. A dryer as set forth in claim 1 wherein:

(a) said speaker includes a cone with a speaker cone axis; and (b) a plurality of ribs are formed in said cone tangentially about said speaker cone axis.

6. A dryer as set forth in claim 1 and including:

(a) a second audio speaker and speaker holder mounted within said bonnet in such a position and orientation that audio information can be selectively conveyed to the user during drying of the user's hair.

7. A dryer as set forth in claim 1 and including:

(a) an audio input jack mounted on said dryer and connected to said speaker;

(b) an audio cable having an output connector configured to enable conductive engagement with said input jack and a source connector configured to enable connection of said cable to an audio signal source; and (c) an audio amplifier connected between said source connector and said output connector.

8. A dryer as set forth in claim 1 wherein:

(a) said holder is formed by an inner portion and an outer portion, said inner and outer portions being connected by a hinge region integral with said inner and outer portions; and (b) said inner and outer portions of said holder are folded about said hinge region to enclose said speaker therein.

9. A dryer as set forth in claim 8 and including:

(a) latch components formed on said inner and outer portions and cooperating to retain said inner and outer portions folded about said hinge region.

10. A bonnet style hair dryer comprising:

(a) a dryer bonnet sized and shaped to accommodate the head of a user;

(b) a hair dryer mechanism selectively communicating heated air to said bonnet;

(c) a folding one-piece speaker holder;

(d) an audio speaker received within said holder and said holder being folded to enclose said speaker therein;

(e) said dryer, bonnet including a substantially rigid inner liner;

(f) a speaker aperture formed through said liner at a position to align with an ear of a user having the user's head within said bonnet;

(g) a speaker mounting lug formed on said liner;

(h) a speaker mounting pawl formed on said speaker holder; and (i) said speaker holder being engagable with said lug and said pawl being engageable with said aperture to enable toolless mounting engagement of said speaker holder with said bonnet in such a position and orientation that audio information can be selectively conveyed to the user during drying of the user's hair.

11. A dryer as set forth in claim 10 wherein:

(a) said holder is formed by an inner grill and an outer case, said grill and said case being connected by a hinge region integral with said grill and said case; and (b) said grill and said case are folded about said hinge region to enclose said speaker therein.

12. A dryer as set forth in claim 10 and including:

(a) latch components formed on said grill and said case and cooperating to retain said grill and said case folded about said hinge region.

13. A dryer as set forth in claim 10 and including:

(a) a latch pawl formed on one of said grill or said case and a pawl receiver formed on an opposite one of said case or said grill, said latch pawl and said pawl receiver cooperating to retain said grill and said case folded about said hinge region.

14. A dryer as set forth in claim 10 and including:

(a) said speaker having a speaker cone constructed of a polymeric film formed to a selected shape.

15. A dryer as set forth in claim 10 wherein:

(a) said speaker cone is formed of a polyester film.

16. A dryer as set forth in claim 10 wherein:

(a) said speaker cone is formed of a polyester film having a film thickness of approximately 70 to 80 micrometers.

17. A dryer as set forth in claim 10 wherein:

(a) said speaker cone has a speaker cone axis; and (b) a plurality of ribs are formed in said cone about said speaker cone axis.

18. A dryer as set forth in claim 10 wherein:

(a) said speaker cone has a speaker cone axis; and (b) a plurality of ribs are formed in said cone tangentially about said speaker cone axis.

19. A dryer as set forth in claim 10 and including:

(a) a second folding one-piece speaker holder;

(b) a second audio speaker mounted received within said second holder and said second holder being folded to enclose said second speaker therein;

(c) a second speaker aperture formed through said liner at a position to align with an opposite ear of said user;

(d) a second speaker mounting lug formed on said liner;

(e) a second speaker mounting pawl formed on said second speaker holder; and (f) said second speaker holder being engageable with said second lug and said second pawl being engageable with said second aperture to enable toolless mounting engagement of said speaker holder with said bonnet in such a position and orientation that audio information can be selectively conveyed to the user during drying of the user's hair.

20. A dryer as set forth in claim 10 and including:

(a) an audio input jack mounted on said dryer and connected to said speaker;

(b) an audio cable having an output connector configured to enable conductive engagement with said input jack and a source connector configured to enable connection of said cable to an audio signal source; and (c) an audio amplifier connected between said source connector and said output connector.

21. A bonnet style hair dryer comprising:

(a) a dryer bonnet sized and shaped to accommodate the head of a user;

(b) a hair dryer mechanism selectively communicating heated air to said bonnet;

(c) a pair of folding one-piece speaker holders;

(d) a pair of audio speakers, each speaker having a speaker cone constructed of a polymeric film formed to a selected shape, and each speaker being received within a respective holder which is folded to enclose the associated speaker therein;

(e) said dryer bonnet including a substantially rigid inner liner;

(f) a pair of speaker apertures formed through said liner at positions to align with respective ears of a user having the user's head within said bonnet;

(g) a pair of speaker mounting lugs formed on said liner;

(h) a speaker mounting pawl formed on each said speaker holder; and (i) each said speaker holder being engageable with a respective one of said lugs and each said pawl being engageable with a respective one of said apertures to enable toolless mounting engagement of said speaker holders with said bonnet in such positions and orientations that audio information can be selectively conveyed to the user during drying of the user's hair.

22. A dryer as set forth in claim 21 wherein each holder includes:

(a) an inner grill and an outer case, said grill and said case being connected by a hinge region integral with said grill and said case; and (b) said grill and said case being folded about said hinge region to enclose said speaker therein.

23. A dryer as set forth in claim 22 and including:

(a) a latch pawl formed on one of said grill or said case and a pawl receiver formed on an opposite one of said case or said grill, said latch pawl and said pawl receiver cooperating to retain said grill and said case folded about said hinge region.

24. A dryer as set forth in claim 21 wherein:

(a) each speaker cone is formed of a polyester film.

25. A dryer as set forth in claim 21 wherein:

(a) each speaker cone is formed of a polyester film having a film thickness of approximately 70 to 80 micrometers.

26. A dryer as set forth in claim 21 wherein:

(a) each speaker cone has a speaker cone axis; and (b) a plurality of ribs are formed in said cone tangentially about said speaker cone axis.

27. A dryer as set forth in claim 21 and including:

(a) a stereophonic input jack mounted on said dryer and connected to said speakers;

(b) a stereophonic audio cable having an output connector configured to enable conductive engagement with said input jack and a source connector configured to enable connection of said cable to a stereophonic audio signal source; and (c) a stereophonic audio amplifier connected between said source connector and said output connector.

* * * * *